US005560435A

United States Patent [19]

Sharp

[11] Patent Number: 5,560,435

[45] Date of Patent: Oct. 1, 1996

[54] METHOD AND APPARATUS FOR DRILLING MULTIPLE OFFSHORE WELLS FROM WITHIN A SINGLE CONDUCTOR STRING

[75] Inventor: Allan C. Sharp, Aberdeen, Scotland

[73] Assignee: ABB Vecto Gray Inc., Houston, Tex.

[21] Appl. No.: 420,257

[22] Filed: Apr. 11, 1995

[51] Int. Cl.[6] ..... E21B 7/04; E21B 7/12; E21B 43/01

[52] U.S. Cl. ..... 175/5; 166/97.5; 166/313; 166/349; 166/366; 166/381; 175/79

[58] Field of Search ..... 175/5, 7, 9, 61, 175/78, 79, 81, 82; 166/313, 349, 366, 97.5, 380, 381, 382, 117.5, 117.6

[56] References Cited

U.S. PATENT DOCUMENTS

| | | | |
|---|---|---|---|
| 2,492,079 | 12/1949 | Wiley | 166/117.5 |
| 4,396,075 | 8/1983 | Wood et al. | 175/79 |
| 4,444,276 | 4/1984 | Peterson, Jr. | 175/61 |
| 4,573,541 | 3/1986 | Josse et al. | 175/78 |
| 5,311,936 | 5/1994 | McNair et al. | 166/50 |
| 5,318,121 | 6/1994 | Brockman et al. | 166/313 |
| 5,322,127 | 6/1994 | McNair et al. | 166/313 |
| 5,325,924 | 7/1994 | Bangert et al. | 166/313 |
| 5,330,007 | 7/1994 | Collins et al. | 166/313 |
| 5,458,199 | 10/1995 | Collins | 166/313 |

*Primary Examiner*—Stephen J. Novosad
*Attorney, Agent, or Firm*—James E. Bradley

[57] ABSTRACT

A method and apparatus are provided for drilling multiple offshore wells from a single conductor casing string. A guide member is provided for securing to a standard casing string, and running downhole and setting within a lower section of the conductor string. The guide member includes multiple guide bores through which standard casing strings are run. A first one of the standard casing strings i secured into one of the multiple guide bores for lowering the guide member into the lower section of the conductor string. A multibore low pressure wellhead housing is mounted to the conductor string as the guide member is being lowered downhole within the conductor string. Once the guide member is set, the first one of the standard casing strings is released from the guide member and passed downward through the guide member for receiving a drill string and guiding the drill string in drilling a first one of the multiple offshore wells. Then, the first casing string is picked up, without being pulled from within the guide member, for joining with more casing and running further downhole through the guide member to case a first one of the multiple offshore wells. A second casing string is then lowered downhole and through the guide member for guiding the drill string. After a second one of the multiple offshore wells is drilled, the second casing string is then run further downhole, through the guide member, and used to case the second offshore well.

20 Claims, 8 Drawing Sheets

METHOD AND APPARATUS FOR DRILLING MULTIPLE OFFSHORE WELLS FROM WITHIN A SINGLE CONDUCTOR STRING

BACKGROUND OF THE INVENTION

1. Field of the Invention

The present invention relates to drilling multiple wells from a single borehole, and in particular to separately drilling multiple offshore wells from a single conductor casing string set within a primary borehole.

2. Description of the Prior Art

Offshore platforms are both expensive to build and costly to operate. Recent trends to optimize production from offshore platforms are becoming evermore prevalent. Offshore platforms have limited space from which wells may be drilled and produced. Typically, a drilling deck, or well deck, for an offshore platform has a limited number of slots through which conductor casing strings extend for drilling and production. These conductor casing strings often extend several hundred feet to a sea floor, and then into a borehole which extends beneath the sea floor.

Prior art methods for drilling multiple wells from a single conductor casing string typically require expensive specialized equipment and downhole tools for drilling and producing multiple wells. This often provides for rather costly logistical requirements for transporting the specialized equipment and tools offshore, as well as rather costly drilling and completion operations, as compared to standard drilling operations for drilling only a single well through a singular conductor casing string. Additionally, the equipment which is used only for drilling, and which is not used in completion operations to become a permanent part of the well, has to be again transported by ocean going vessel when it is no longer required. This provides additional costs for transporting the equipment.

SUMMARY OF THE INVENTION

A method and apparatus are provided for drilling multiple offshore wells from a single conductor casing string. A guide member is provided for securing to a standard casing string, and running downhole and setting within a lower section of the conductor string. The guide member includes multiple guide bores through which standard casing strings are run. A first one of the standard casing strings is secured into one of the multiple guide bores for lowering the guide member into the lower section of the conductor string. A multibore low pressure wellhead housing is mounted to the conductor string as the guide member is being lowered downhole within the conductor string. Once the guide member is set, the first one of the standard casing strings is released from the guide member and passed downward through the guide member for receiving a drill string and guiding the drill string in drilling a first one of the multiple offshore wells. Then, the first casing string is picked up, without being pulled from within the guide member, for joining with more casing and running further downhole through the guide member to case a first one of the multiple offshore wells. A second casing string is then lowered downhole and through the guide member for guiding the drill string. After a second one of the multiple offshore wells is drilled, the second casing string is then run further downhole, through the guide member, and used to case the second offshore well.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
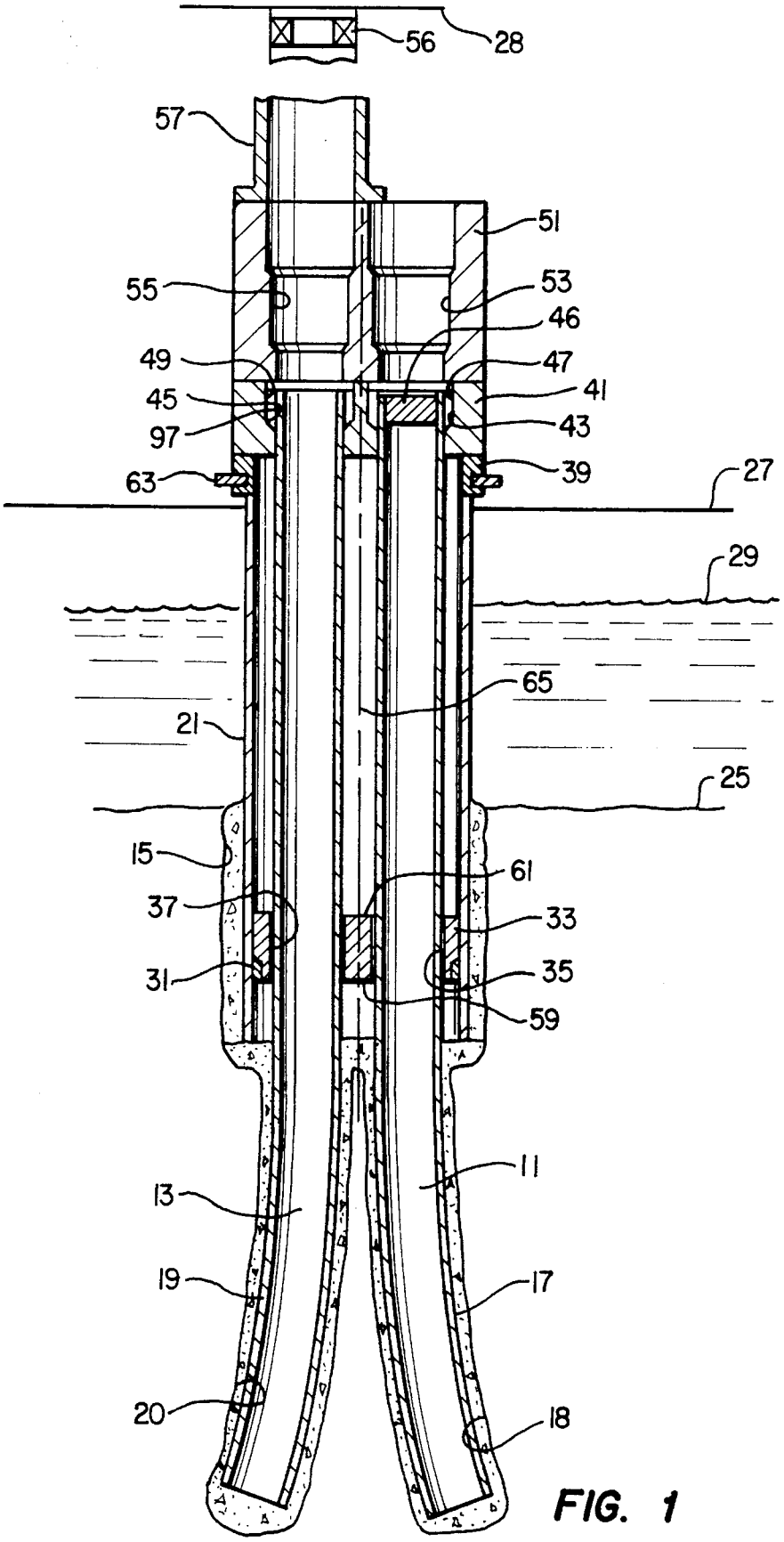
FIG. 1 depicts an elevational, longitudinal section view of multiple offshore wells which have been drilled from within a single conductor casing string.

FIG. 1 is an elevational view of multiple offshore wells 11, 13, which have been drilled and cased according to the present invention. Multiple offshore wells 11, 13 are lower subsea wells which have both been drilled from a single, large diameter, primary borehole 15. Multiple wells 11, 13 include lower casing strings 17, 19, which have been set in lower boreholes 18, 20. Conductor casing string 21 been cemented within primary borehole 15 and extends upwards through ocean floor 25, to well deck 27 of an offshore platform above water surface 29. Conductor casing string 21 typically extends several hundred feet below ocean floor 25. The distance from well deck 27 to the ocean floor 25 can often be several hundred feet. The distance from well deck 27 to rig floor 28 is usually around 90 feet. Conductor string 21 has a profile 31 which provides an interior seat for permanently setting downhole drilling guide 33 within a lower section of conductor 21.

Downhole drilling guide 33 provides a downhole guide member having multiple side-by-side guide bores 35, 37 through which lower casing strings 17, 19 separately extend, respectively. Wellhead 39 is mounted on top of conductor casing string 21. Low pressure wellhead housing 41 is mounted to conductor casing string 21 above wellhead 39.

Wellhead housing 41 is a low pressure multiple bore head which is part of a multiple bore wellhead. Wellhead housing 41 includes multiple side-by-side upper guide bores 43, 45 through which lower casing strings 17, 19 separately extend. Two profiles 47, 49 are defined by bores 43, 45, respectively. Plug 46 is seated in profile 47 to seal lower casing string 17 for later drilling and completion operations. Dual-bore wellhead housing 51 is a high pressure wellhead housing which is mounted above wellhead housing 41 and includes two profiles 53, 55 defined therein for later hanging liner casing strings therein. High pressure riser 57 is mounted to wellhead housing 51, and typically a blow-out preventer 56 is mounted above high pressure riser 57 for drilling through lower casing string 19, which is set in lower borehole 20.

Downhole drilling guide 33 is a cylindrical member having a downhole end 59 which has a flat, planar surface. Multiple guide bores 35, 37 extend through downhole drilling guide 33 in a side-by-side, parallel alignment, in a transverse relation to downhole end 59. In the preferred embodiment, the center lines for multiple guide bores 35, 37 are perpendicular to the flat planar surface of downhole end 59. Downhole drilling guide 33 further has an uphole end. 61 which is also a flat, planar surface which is preferably parallel to downhole end 59.

Multiple guide bores 35, 37 extend in transverse relation to ends 59, 61, and are preferably perpendicular to ends 59, 61. The centerlines for guide bores 35, 37 are offset from and parallel to centerline 65 of conductor string 21. Drilling guide 33 has a circumferentially extending exterior which preferably defines an exterior profile for setting within interior profile 31 of conductor casing string 21. Interior profile 31 and the exterior profile for guide 33 together define a support means for securing downhole guide member 33 within conductor string 21. Other types of support means for setting downhole guide 33 within casing string 21 are well known in the art, such as using slip-gripping type of means.

Wellhead 39 is a starter head having screws 63 (two shown) which laterally extend radially inward towards centerline 65 of conductor casing string 21, in transverse relation thereto. Screws 63 are used for extending radially inward into head 39 to hang downhole drilling guide 33 for installation of multiple bore wellhead housing 41 during run-in of downhole drilling guide 33, as discussed below. Screws 63 are later retracted radially outward from within head 39 to allow downhole drilling guide member 33 to be lowered downhole after wellhead housing 41 is mounted to wellhead 39, above conductor string 21.

Figure 2:
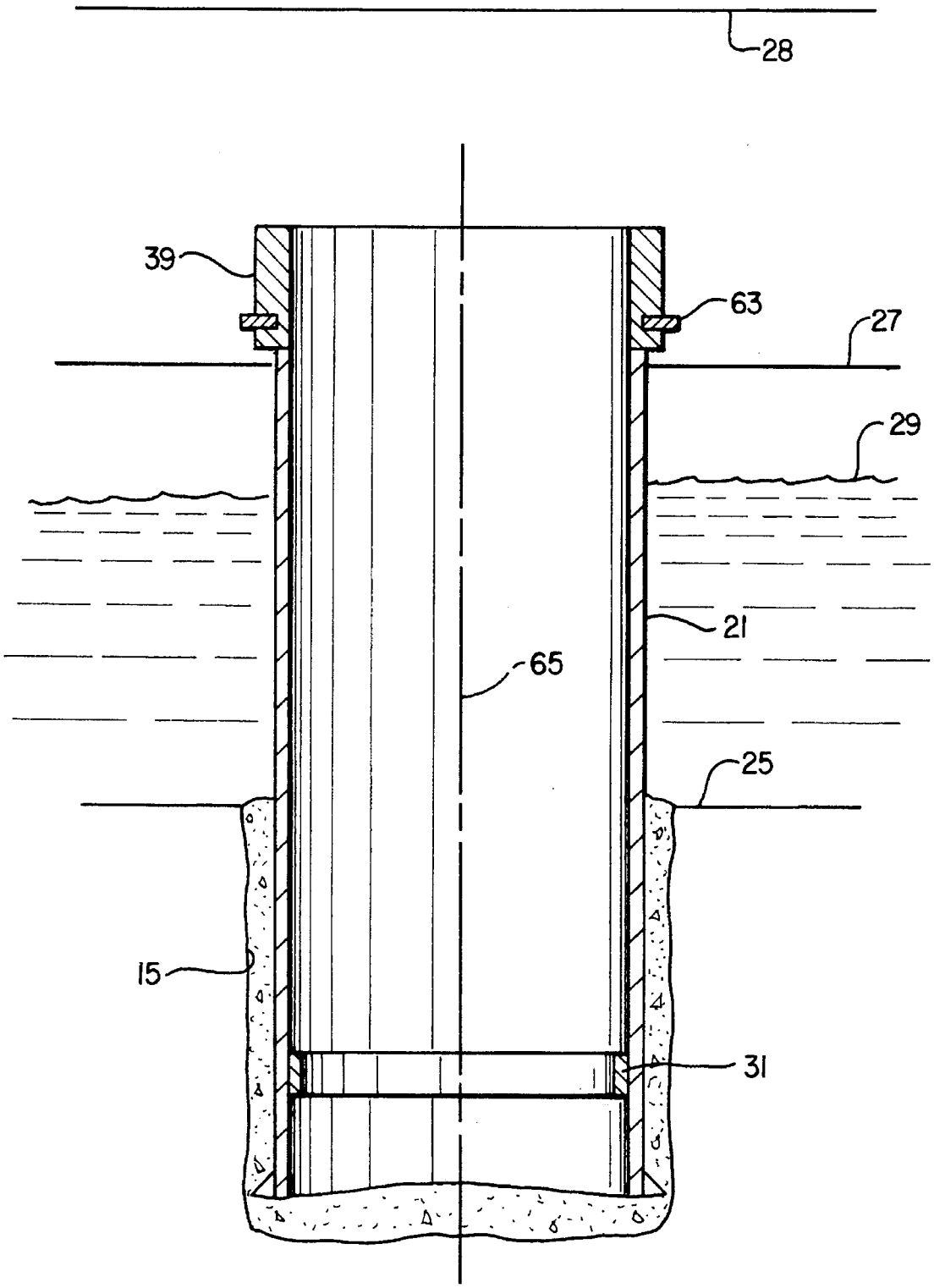
FIG. 2 depicts a primary borehole after drilling and cementing the conductor casing string therein.

FIG. 2 depicts primary borehole 15 after primary borehole 15 has been drilled and conductor casing string 21 has been cemented therein. Conductor casing string 21 is preferably run into borehole 15 with profile 31 secured within a lower section of casing string 21. Then, wellhead 39 is secured to the top of conductor string 21.

Figure 3:
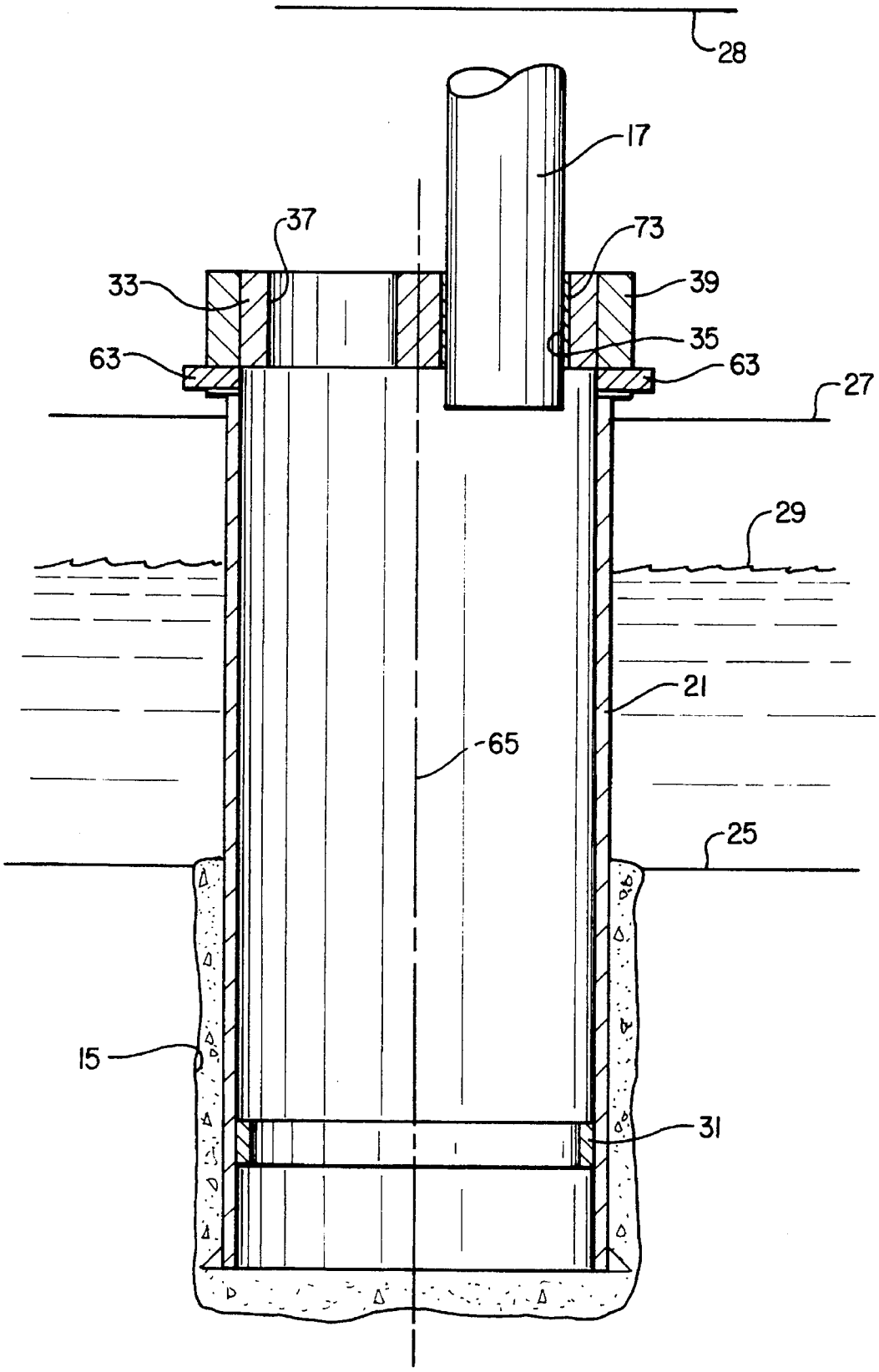
FIG. 3 depicts operations for running a downhole guide member within the single conductor casing string and mounting a wellhead housing to the conductor casing according to the present invention.

FIG. 3 depicts a bottom section of lower casing string 17 secured to downhole drilling guide 33 by connector 73. Connector 73 is an attachment means which releasably latches into bore 35 of drilling guide 33 to releasably secure the bottom of casing string 17 to downhole drilling guide 33. Various types of latches or connectors may be utilized for an attachment means to releasably secure casing string 17 to downhole drilling guide 33, and are well known in the art.

Support screws 63 in wellhead 39 are rotated to extend inwardly towards center line 65 to provide a support means for supporting downhole drilling guide member 33 so that wellhead housing 41 (shown in FIG. 4) may be secured on top of wellhead 39, after guide member 33 is lowered within wellhead 39. Guide member 33 is secured to casing 17 and then lowered on top of screws 63 in head 39. Casing string 17 is then broken so that wellhead housing 41 can be mounted on top of wellhead 39 (shown in FIG. 4). Casing string 17 is then made back up and run downhole into conductor string 21 with guide member 33 secured to the lower end of casing string 17.

Figure 4:
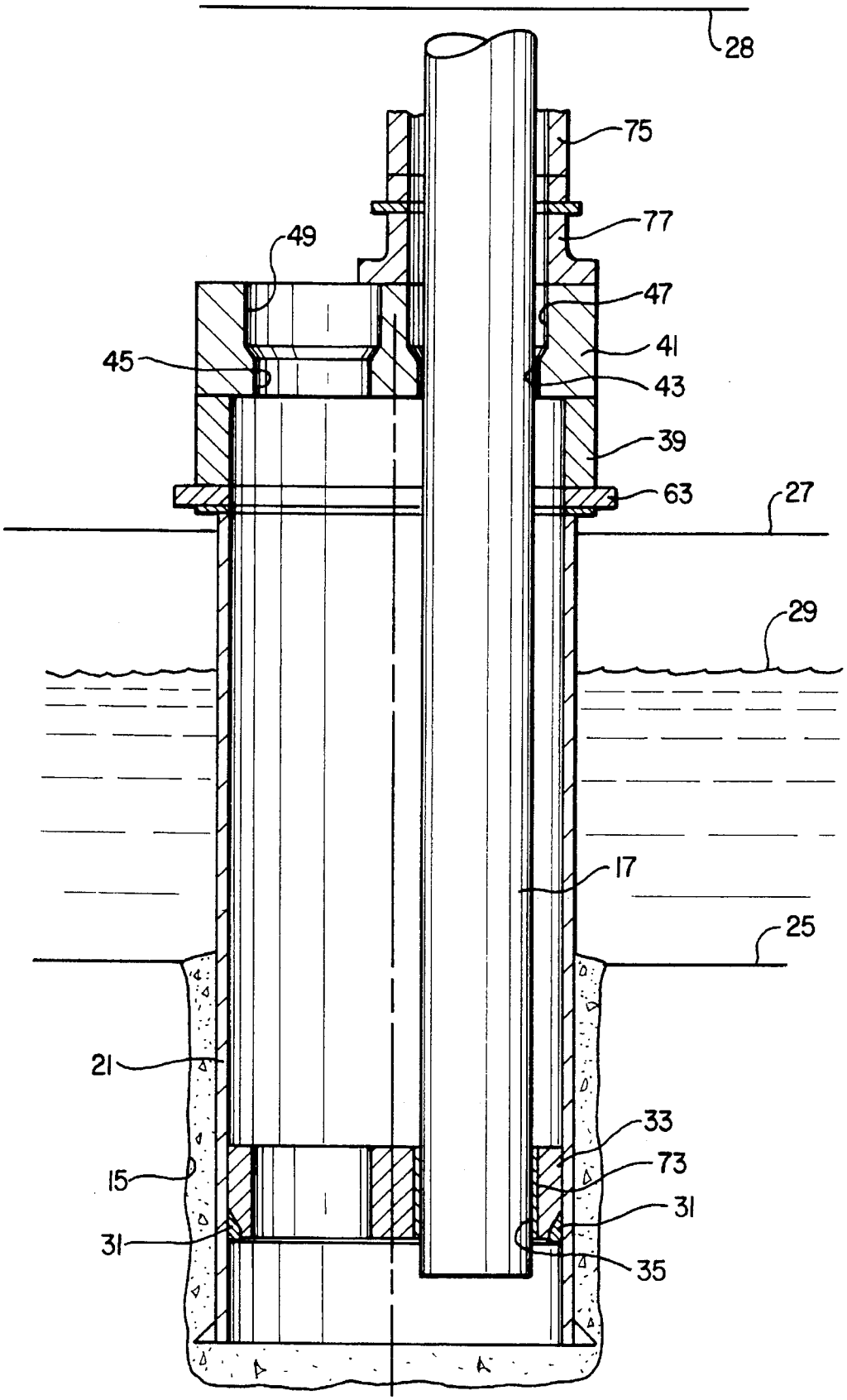
FIG. 4 depicts operations for setting the downhole guide member within the conductor casing string after the low pressure wellhead housing has been mounted to the conductor casing string above the primary borehole.

FIG. 4 depicts downhole drilling guide 33 after it has been run inside of conductor casing 21 and set within profile 31. Wellhead housing 41 has been mounted to wellhead 39 and conductor casing string 21. Low pressure riser 75 and hang-off spool 77 have been mounted to the top of wellhead housing 41, and riser 75 extends upward to rig floor 28. Riser 75 extends about 90 feet from well deck 27 to rig floor 28. A blowout preventer or a diverter 76 (shown in FIG. 5) will be installed to low pressure riser 75 for safety.

Figure 5:
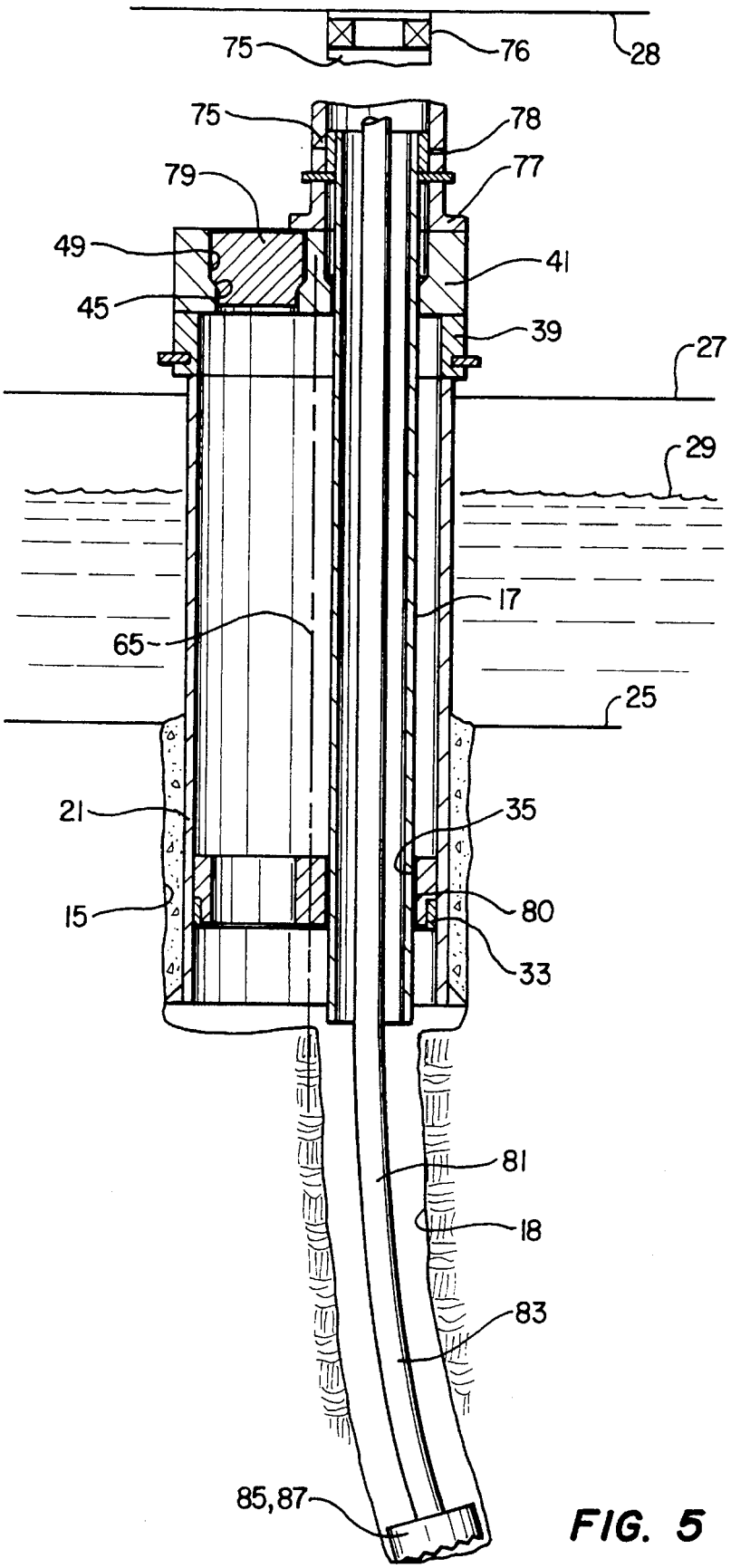
FIG. 5 depicts operations for lowering a casing string beneath the downhole guide member and drilling a first one of the multiple offshore wells from within the conductor casing string.

FIG. 5 depicts casing 17 after guide member 33 is set within conductor 21, and casing 17 has been released from guide member 33 and lowered downhole through guide member 33. Casing 17 is released by unlatching attachment means 73. A temporary hanger 78 secured to the upper end of casing string 17 and is used to hang casing string 17 within hang-off spool 77. The weight of casing 17 is now supported by hang-off spool 77. The top of casing 17 is within hang-off spool 77. When lowering hanger 78 into hang-off spool 77, the lower end of casing 17 will be lowered at least 90 feet below guide member 33. Thus, when the top of casing 17 is later pulled up to rig floor 28 to remove temporary hanger 78, the lower end of casing 17 will not be removed from within bore 35 in guide member 33 prior to running downward into borehole 18. This results in the lower end of casing 17 not having to be located in relation to bore 35 in guide member 33, which is set several hundred feet downhole within conductor 21. Plug 79 has been secured within profile 49 in wellhead housing 41 to seal upper guide bore 45. Temporary hanger 78 includes a seal means for sealing between casing 17 and hang-off spool 77.

An annular clearance, defined by the difference in diameter between casing 17 and bore 35, provides a gap 80. Gap 80 allows casing 17 to slidably extend through drilling guide 33 so that casing 17 may be run downhole within bore 35 for guiding drill string 81, and later casing secondary borehole 18. Drilling guide 33 will laterally retain casing string 17 from moving in a lateral direction in relation to the centerline 65 of casing string 21, as casing 17 is moved downhole in relation to drill guide 33. Casing string 17 is only laterally retained by downhole guide 33 at the selected position in primary borehole 15 at which drill guide 33 is set.

Drill string 81 is then lowered through casing string 17 to drill lower borehole 18. Drill string 81 includes drill pipe 83, beneath which are secure drill bit 85 and underreamer 87 (which are schematically depicted). Underreamer 87 may be of the type well known in the art, which may be utilized for passing through casing string 17 to drill borehole 18 with a diameter which is larger than the exterior of casing 17 to provide an adequate annulus for properly cementing casing 17 therein.

After lower borehole 18 is drilled, drill string 81 is removed and casing 17 is run to the bottom of lower borehole 18. Just the upper end of casing 17 well be picked up to rig floor 28 to remove temporary liner hanger 78. When the upper end of casing 17 is picked up to the rig floor, the lower end will not be pulled higher than guide member 33 so that casing 17 will not be removed from extending within guide member 33. Then sections of casing will be added to the top of casing string 17, as casing string 17 is lowered to the bottom of lower borehole 18.

Figure 6:
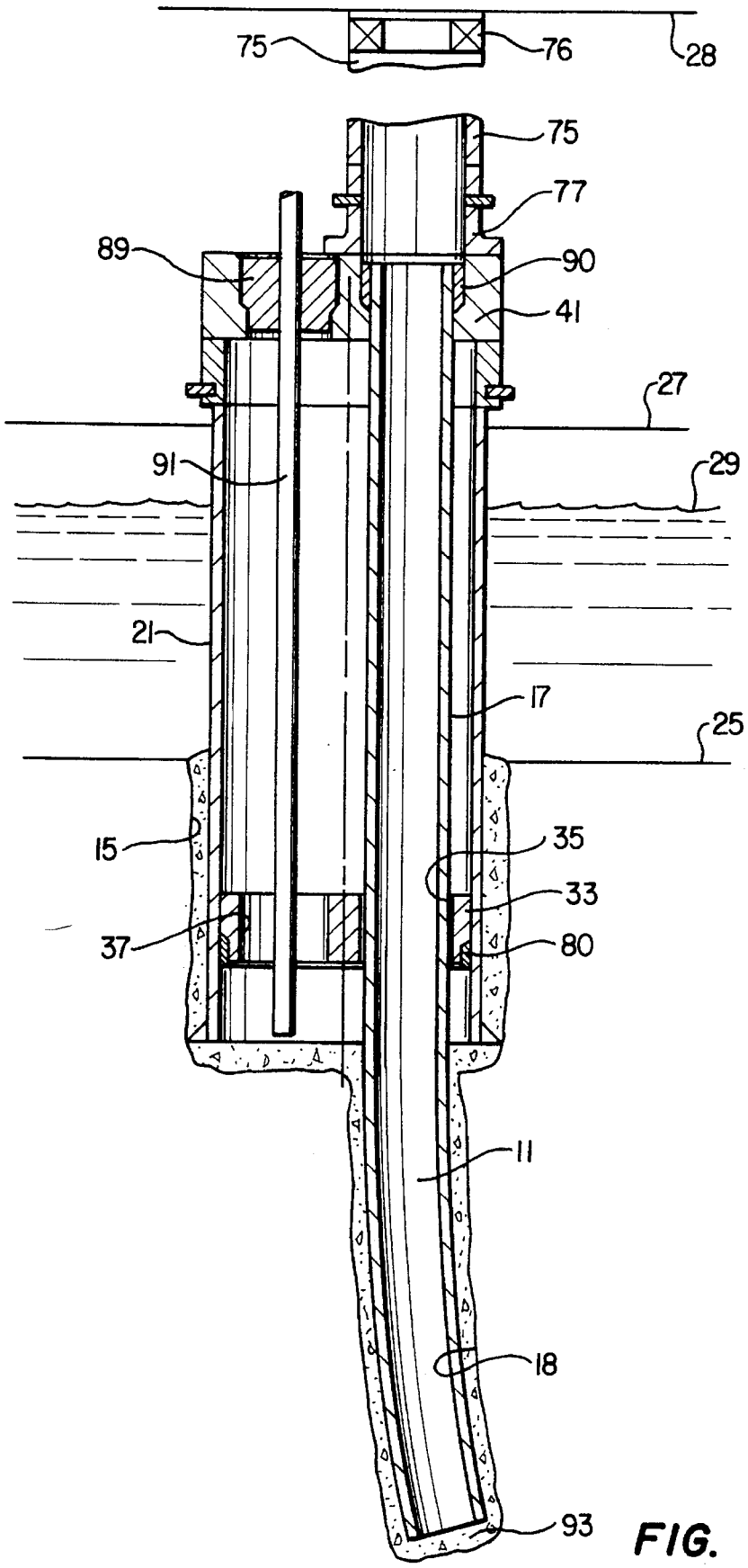
FIG. 6 depicts operations for cementing a first one of the lower casing strings within the first one of the multiple offshore wells drilled from the conductor casing string.

FIG. 6 depicts offshore well 11 after lower casing string 17 has been run within borehole 18. A permanent hanger 90 has been used to secure casing 17 within low pressure wellhead housing 41. Permanent hanger 90 includes a seal for sealing between casing 17 and housing 41. Plug 79 (shown in FIG. 5) may be replaced with plug 89 through which circulation string 91 extends. Circulation string 91 may be provided to extend through guide bore 37 of downhole drilling guide 33 to prevent return fluids from passing through bore 37. Lower casing string 17 is cemented within borehole 18, prior to drilling borehole 20 (shown in FIG. 7), to place cement 93 downhole and within the annulus between casing 17 and borehole 18. Circulation string 91 of tubing extends through conductor 21 to prevent cement from passing within bore 37 in guide member 33. After casing 17 is cemented within borehole 18, circulation string 91 and plug 89 are removed.

Figure 7:
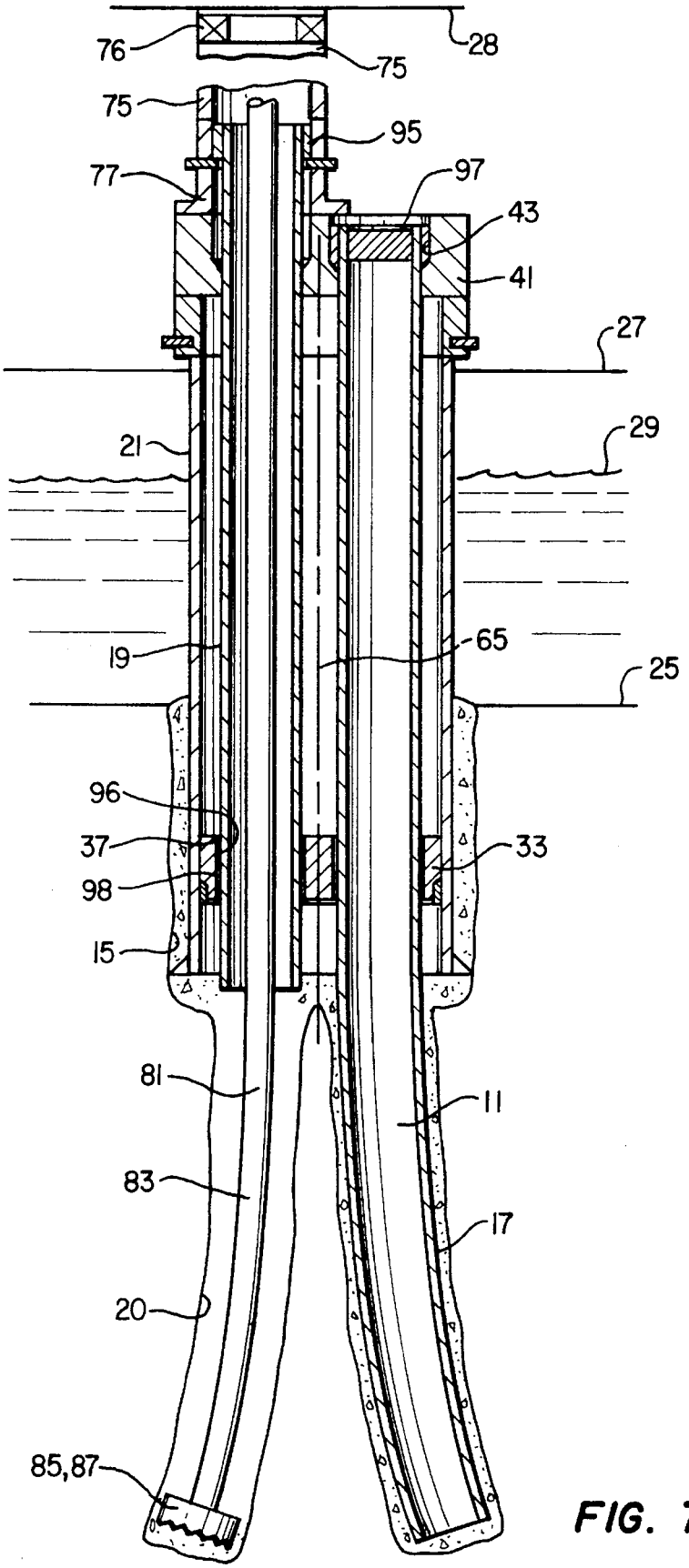
FIG. 7 depicts operations for drilling a second offshore well from the conductor casing string according to the present invention.

FIG. 7 depicts drilling of lower, secondary borehole 20. A section of casing string 19 has been lowered through guide bore 37 to guide drill string 81 downhole through conductor casing string 21 to drill borehole 20. Preferably, casing string 19 extends at least 90 feet through guide member 33 so that it will not have to be relocated in relation to guide bore 37 when it is picked back up to rig floor 28 for making up more sections of casing 19 to run downhole and case borehole 20. Casing 19 slidably extends through guide bore 37 in downhole drilling guide 33. A gap 96 extends between casing 19 and bore 37 in drill guide 33 to allow casing 19 to slidably move downhole within guide 33. Guide 33 retains casing 19 against lateral movement in relation to centerline 65 at the selected position at which downhole drill guide 33 is set.

Temporary casing hanger 95 is secured to casing 19 and supports the weight of casing 19 within hang-off spool 77. Hanger 95 includes a seal for sealing between spool 77 and casing 19. Plug 97 has been secured in upper guide bore 43 of wellhead housing 41 to seal lower casing string 17. Drill bit 85 and underreamer 87 have been run through casing 19 for drilling lower borehole 20.

Drill bit 85 and underreamer 87 are rotated for drilling and underreaming lower borehole 20 to the size for running casing 19 to the bottom of borehole 20, with an adequate annulus for properly cementing casing 19 therein. After borehole 20 is drilled and underreamed, drill string 81 is pulled up through casing 19. The top of casing 19 is then pulled from within spool 77 to rig floor 28, without removing the lower end of casing 19 from within guide bore 37.

Referring again to FIG. 1, casing 19 is shown after it is lowered into borehole 20 and permanent casing hanger 97 has been installed to support the weight of casing 19. Casing hanger 97 includes a seal means for sealing between casing 19 and low pressure wellhead housing 41. Casing 19 is cemented within borehole 20. Dual bore wellhead housing 51 is then mounted on top of wellhead housing 41. High pressure riser 57 is secured on top of dual bore wellhead housing 51, and extends upwards to rig floor 28. A blow-out preventer 56 has been mounted to high pressure riser 57. Multiple offshore wells 11, 13 are now ready for drilling to deeper depths and setting liner casing strings therein.

Figure 8:
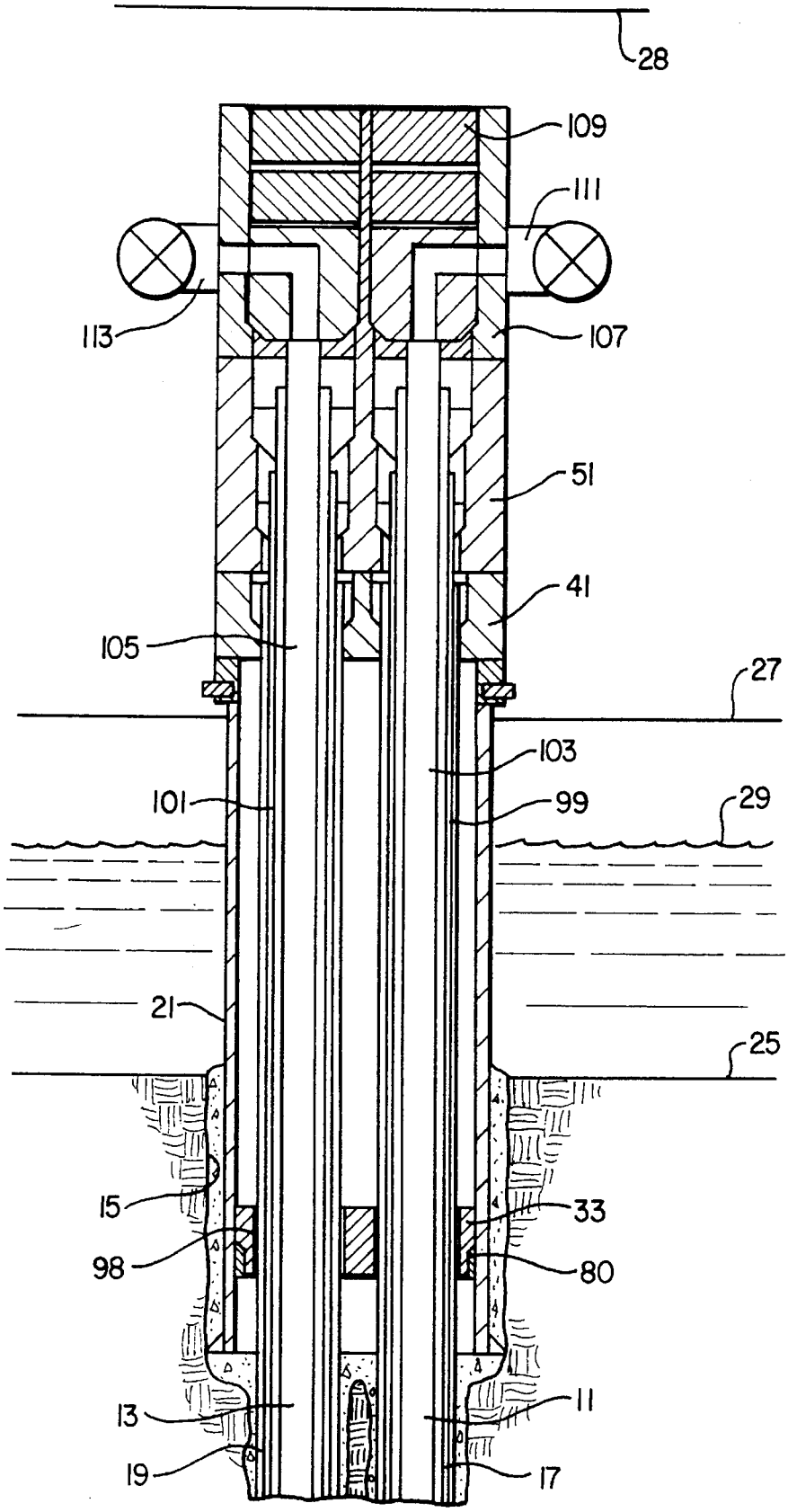
FIG. 8 depicts the multiple offshore wells which have been drilled and completed from within the conductor casing string according to the present invention.

FIG. 8 depicts multiple offshore wells 11, 13 after they have been drilled to deeper depths and then completed. Dual bore horizontal tree 107 has been installed on top of dual bore wellhead housing 51, with crown plugs 109 installed therein. Production liners 99, 101 and production tubing strings 103, 105 (which are schematically depicted) have been set within multiple offshore wells 11, 13, respectively. Permanent casing and tubing hangers have been installed. Offshore wells 11, 13 are separate wells extending through single conductor casing string 21, which extends upwards to well deck 27. Offshore wells 11, 13 may be separately drilled, completed, produced and worked over using standard equipment, without disturbing production in the other well.

An example of a casing program according to the present invention would be to drill primary borehole 15 with a 36 inch diameter. Then, 32 inch casing may be used for conductor casing string 21. The 32 inch casing string 21 can interiorly accommodate two 13⅜ inch casing strings 17, 19. A 12¼ inch drill bit could be used for drill bit 85, and then the multiple boreholes 18, 20 could be underreamed to a diameter of 16 inches with underreamer 87. Boreholes 18, 20 of 16 inches are large enough to receive the 13⅜ inch casing strings 17, 19, respectively, and provide a large enough annulus to assure that the two 13⅜ inch casing strings 17, 19 can be properly cemented in boreholes 18, 20 to provide offshore wells 11, 13, respectively. Well depths of up to 2,000 feet may be easily achieved for the 13⅜ inch casing strings, depending on the burst capacity of 13⅜ inch casing strings 17, 19. Then, the two offshore wells 11, 13 may be separately drilled to deeper depths and 7⅝ inch liner casing strings 99, 101 set according to a standard drilling program. 5½ inch diameter production tubing strings 103, 105 can then be set in the 7⅝ inch liner casing strings 99, 101 when offshore wells 11, 13 are completed The present invention provides several advantages over the prior art. Multiple offshore wells may be drilled and completed through a single conductor string extending through a single slot in a well deck of an offshore platform using standard casing sizes and drilling programs for both offshore wells. The multiple offshore wells may separate from one another and extend from within the primary borehole bore at deep, downhole depths. Sections of standard casing strings are run downhole and extend through a downhole drilling guide for use to guide a drill string to selectable downhole positions, prior to lowering the standard casing strings further downhole and cementing them within the boreholes drilled with the drill string. Thus, large amounts of additional materials and casing are not required when multiple offshore wells are drilled from a single conductor casing string according to the present invention. Further, the present invention overcomes the problem encountered in drilling two offset wells of selectively stabbing a drill string and later two casing strings into a particular one of two bores in a drilling guide member set hundreds of feet down within a conductor string.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

I claim:

1. An apparatus for drilling and casing first and second offshore wells from an offshore platform, the apparatus comprising in combination:

a conductor string extending from the offshore platform, down through a sea floor and to a selected depth in a primary borehole;

a guide member having side-by-side multiple guide bores sized for receiving first and second casing strings, and passing the casing strings downhole through the guide member;

support means for securing the guide member within a lower section of the conductor string;

attachment means for releasably securing a lower end of the first casing string to a first one of the guide bores for lowering the guide member from the offshore platform and into engagement with the support means in the conductor string;

the attachment means being releasable for releasing the lower end of the first casing string from the guide member, and allowing the first casing string to be lowered through the first one of the guide bores and the guide member; and wherein the first casing string serves as a guide for a drill string used to drill the first offshore well, and then is lowered through the guide member to serve as casing in the first offshore well.

2. The apparatus according to claim 1, wherein the support means comprises:

a profile disposed in the lower section of the conductor string; and a latch for securing the guide member within the profile in the lower section of the conductor string.

3. The apparatus according to claim 1, further comprising:

a wellhead housing mounted to the conductor string and having a plurality of side-by-side upper guide bores which extend therethrough for receiving the first and second casing strings when the drill string is being passed through the first and second casing strings to drill the first and second offshore wells, respectively; and the upper guide bores of the wellhead housing having load shoulders for supporting the casing strings.

4. The apparatus according to claim 1, wherein the attachment means allows the first casing string to be moved down through the guide member to an initial hang-off depth before drilling, and then to be picked up a distance less than the first casing string is moved down through the guide member to the initial hang-off depth, to attach subsequent sections of casing for running the first casing string through the guide member to case the first offshore well.

5. The apparatus according to claim 1, wherein the second casing string is run through a second one of the guide bores to pass through the guide member, and serves to guide the drill string in drilling the second offshore well.

6. The apparatus according to claim 1, further comprising:

starter means secured to an upper end of the conductor string to initially support the guide member during run-in for mounting the wellhead housing prior to setting the guide member within the lower section of the conductor string.

7. The apparatus according to claim 1, further comprising:

a circulation string extending from the offshore platform, downhole within the conductor string, and through a second one of the guide bores for receiving return circulation fluids and passing the fluids uphole through the guide member and the conductor string as the first casing string is being cemented within the first offshore well.

8. An apparatus for drilling and casing first and second offshore wells from an offshore platform, the apparatus comprising in combination:

a conductor string extending from the offshore platform, down through a sea floor and to a selected depth in a primary borehole;

a guide member having side-by-side first and second guide bores for receiving and passing first and second casing strings to the first and second offshore wells, respectively;

support means for securing the guide member within a lower section of the conductor string;

attachment means for releasably securing a lower end of the first casing string into the first guide bore for lowering the guide member from the offshore platform and into supporting engagement with the support means in the lower section of the conductor string;

the attachment means being releasable for releasing the lower end of the first casing string from the first guide bore, and allowing the first casing string to be lowered through the guide member;

a wellhead housing mounted to the conductor string, the wellhead housing having a plurality of side-by-side upper bores which extend therethrough for separately receiving the casing strings, wherein the upper bores have load shoulders for supporting the casing strings;

wherein the first casing string serves as a guide for a drill string, and then is lowered further downhole through the guide member to serve as casing in the first offshore well; and wherein the second casing string is run downhole through the through the second guide bore of the guide member and serves to guide the drill string in drilling the second offshore well, and then is lowered further downhole through the guide member to serve as casing in the second offshore well.

9. The apparatus according to claim 8, wherein the support means comprises:

a profile disposed in the lower section of the conductor string; and a latch for securing the connector within the profile in the lower section of the conductor string.

10. The apparatus according to claim 8, wherein the attachment means allows the first casing string to be moved down through the guide member to an initial hang-off depth before drilling, and then to be picked up a distance less than the first casing string is moved down through the guide member to the initial hang-off depth, to attach subsequent sections of casing for running the first casing string through the guide member to case the first offshore well.

11. The apparatus according to claim 8, further comprising:

starter means secured to an upper end of the conductor string to initially support the guide member during run-in for mounting the wellhead housing prior to setting the guide member within the lower section of the conductor string.

12. The apparatus according to claim 8, further comprising:

an uphole starter head secured to an upper end of the conductor string, the starter head having support members which are selectively extended radially inward to initially support the guide member during run-in for mounting the wellhead housing to the conductor string prior to running the guide member downhole, and wherein the support members are selectively retracted after the wellhead housing is mounted to the conductor string to allow the guide member to pass downhole within the lower section of the conductor string.

13. The apparatus according to claim 8, further comprising:

a circulation string extending through one of the upper bores in the wellhead housing, downhole within the conductor string, and through the second guide bore for circulating return fluids uphole from beneath the guide member and through the conductor string when the first casing string is cemented within the first offshore well.

14. A method for drilling and casing two offshore wells from an offshore platform, comprising the steps of:

(a) forming a primary borehole to a selected depth and installing a conductor string from the offshore platform, through the sea floor, and to the bottom of the primary borehole;

(b) securing a guide member which has two side-by-side bores to the lower end of a first string of casing and lowering the guide member into the conductor string;

(c) securing the guide member to a lower section of the conductor string; then (d) lowering a drill string through the first string of casing and the guide member, and drilling a first secondary borehole to a selected depth; then (e) lowering the first string of casing through the guide member to the bottom of the first secondary borehole by attaching additional sections of casing to the upper end of the first string of conductor; then (f) cementing the first string of casing in the first secondary borehole; then (g) lowering a second string of casing into the conductor in registry with the second bore of the guide member; and then (h) repeating steps (d)–(f) for the second secondary borehole and the second string of casing.

15. The method according to claim 14, further comprising:

lowering the first casing string through the guide member to an initial hang-off depth prior to drilling the first secondary borehole.

16. The method according to claim 14, further comprising:

mounting a dual bore wellhead to an upper end of the conductor string, prior to securing the guide member to the lower section of the conductor string.

17. The method according to claim 14, further comprising:

after cementing the first and second casing strings within the first and second secondary boreholes, respectively, drilling through the first and second casing strings to well depths which are deeper than the first and second secondary boreholes.

18. The method according to claim 14, wherein the step of cementing the first string of casing in the first secondary borehole comprises the steps of:

running a circulation string down through the conductor string and into the guide member, wherein the first casing string extends through a first one of the two side-by-side bores and the circulation string extends through a second one of the two side-by-side bores; and passing return fluids from an annulus between the first string of casing and the first secondary borehole, uphole through the circulation string and from within the conductor string.

19. The method according to claim 14, further comprising:

mounting a hang-off spool to the top of the conductor string;

mounting a temporary hanger to the top of the first casing string;

lowering the first casing string through the guide member to an initial hang-off depth prior to drilling the first secondary borehole; and supporting the first string of casing at the top of the conductor string by hanging the temporary hanger in the hang-off spool.

20. The method according to claim 14, further comprising:

mounting a hang-off spool to the top of the conductor string;

mounting a temporary hanger to the top of the first casing string;

lowering the first casing string through the guide member to an initial hang-off depth prior to drilling the first secondary borehole;

supporting the first string of casing at the top of the conductor string by hanging the temporary hanger in the hang-off spool; and then after drilling the first secondary borehole and removing the drill string from the first string of casing, and prior to step (e) above, picking up the first string of casing from the initial hang-off depth a distance less than the first string of casing was lowered when moved down through the guide member to the initial hang-off depth, to remove the temporary hanger to allow subsequent sections of casing to be attached to the first string of casing and the first string of casing to be lowered to the bottom of the first secondary borehole.

* * * * *